US008240929B2

(12) United States Patent
Kohyama

(10) Patent No.: US 8,240,929 B2
(45) Date of Patent: Aug. 14, 2012

(54) PRINTER WITH IMPROVED FEED FROM PAPER ROLL

(75) Inventor: Takuro Kohyama, Nishitokyo (JP)

(73) Assignee: Citizen Holdings Co., Ltd., Tokyo (JP)

( * ) Notice: Subject to any disclaimer, the term of this patent is extended or adjusted under 35 U.S.C. 154(b) by 520 days.

(21) Appl. No.: 11/658,350

(22) PCT Filed: Oct. 4, 2005

(86) PCT No.: PCT/JP2005/018365

§ 371 (c)(1),
(2), (4) Date: Jan. 24, 2007

(87) PCT Pub. No.: WO2006/038624

PCT Pub. Date: Apr. 13, 2006

(65) Prior Publication Data

US 2008/0310903 A1 Dec. 18, 2008

(30) Foreign Application Priority Data

Oct. 6, 2004 (JP) ..... 2004-294208

(51) Int. Cl.
*B65H 16/02* (2006.01)

(52) U.S. Cl. ..... 400/613; 400/618

(58) Field of Classification Search ..... 400/613, 400/618, 619; 242/595, 595.1; *B41J 15/02, B41J 15/04; B65H 16/02, 23/10, 16/08*
See application file for complete search history.

(56) References Cited

U.S. PATENT DOCUMENTS

| | | | | |
|---|---|---|---|---|
| 5,060,877 | A * | 10/1991 | Bullivant | 242/564.5 |
| 5,533,821 | A * | 7/1996 | Awai et al. | 400/619 |
| 2005/0232678 | A1 * | 10/2005 | Mochizuki et al. | 400/621 |

FOREIGN PATENT DOCUMENTS

| | | | |
|---|---|---|---|
| JP | 58-022245 | | 2/1983 |
| JP | 59022840 | A * | 2/1984 |
| JP | 60-36247 | | 3/1985 |
| JP | 63-119054 | | 8/1988 |
| JP | 03096379 | A * | 4/1991 |
| JP | 4-176674 | | 6/1992 |
| JP | 6-247600 | | 9/1994 |
| JP | 7-33291 | | 2/1995 |
| JP | 07033291 | A * | 2/1995 |
| JP | 8-300752 | | 11/1996 |
| JP | 9-254473 | | 9/1997 |

(Continued)

OTHER PUBLICATIONS

JPO Abstract of JP 59022840 A.*

(Continued)

*Primary Examiner* — Judy Nguyen
*Assistant Examiner* — Jennifer Simmons
(74) *Attorney, Agent, or Firm* — Smith, Gambrell & Russell, LLP

(57) ABSTRACT

A printer (1) comprises a printing section (2) and paper roll holder (3) located beside or under the printing section. The paper roll holder (3) has a receiving portion (7) supporting a paper roll (10) from below and a drawer portion (8). A guide member (12) that acts on a paper sheet is located between the receiving portion (7) and the drawer portion (8). The paper sheet between the receiving portion (7) and the drawer portion (8) is inclined to a horizontal side by the guide member (12).

3 Claims, 6 Drawing Sheets

FOREIGN PATENT DOCUMENTS

| | | |
|---|---|---|
| JP | 9-277637 | 10/1997 |
| JP | 10-310291 | 11/1998 |
| JP | 11-157716 | 6/1999 |
| JP | 2000-103549 | 4/2000 |
| JP | 2000-309134 | 11/2000 |
| JP | 2005-23933 | 9/2005 |

OTHER PUBLICATIONS

JPO Machine Translation of JP 07033291 A.*

U.S. Application entitled "Printer", filed Jan. 24, 2007, Takuro Kohyama.

Notice of Grounds for Rejection dated Jul. 27, 2010 for Japanese Application No. 2006-539302 with English translation.

* cited by examiner (a)

(b)

PRINTER WITH IMPROVED FEED FROM PAPER ROLL

TECHNICAL FIELD

The present invention relates to a printer of a type such that a paper roll is placed on a receiving portion of a paper roll holder so that the outer peripheral surface of the paper roll is supported by the receiving portion and a paper sheet paid out from the paper roll is printed.

BACKGROUND ART

Generally known is a printer of a type such that a paper roll is placed on a receiving portion of a paper roll holder and a paper sheet paid out from the paper roll is printed. In this printer, the paper roll rotates on the receiving portion as the paper sheet is paid out from the paper roll.

In the printer of this type, a shortage of the residual quantity of the paper roll is detected by utilizing a reduction of the radius of the paper roll and lowering (or movement toward the receiving portion) of the position of its roll core (see Japanese Patent Application Laid-Open No. 4-176674).

If the paper roll is lightened in weight with its residual quantity lessened, however, the paper roll tends to jump up from the receiving portion or roll on the receiving portion, urged by a force that is generated when the paper sheet is paid out from the paper roll. Thereupon, the position of the paper roll varies, so that the residual quantity of the paper roll cannot be detected. If the paper roll lifts off the receiving portion, moreover, fixed-rate feed to a printing section may be destabilized or noise may be generated, in some cases.

In order to prevent the paper roll from lifting off the receiving portion, therefore, there is proposed a method in which the paper roll that is placed on the receiving portion of the paper roll holder is pressed down with a spring-urged pressure member from above (see Japanese Patent Applications Laid-Opens Nos. 58-22245 and 4-176674).

However, the printer having the pressure member constructed in this manner requires a mechanism for retreating the pressure member from a path of movement of the paper roll toward the receiving portion lest the pressure member hinder the paper roll from being loaded into the paper roll holder.

DISCLOSURE OF THE INVENTION

The object of this invention is to prevent a paper roll from lifting upward in a paper roll holder when the paper roll in the paper roll holder is paid out by feed rollers in a printing section, in a printer with the paper roll holder located beside or under the printing section.

In order to achieve the above object, a printer according to the present invention comprises a printing section and a paper roll holder. The paper roll holder has a receiving portion which supports an outer peripheral surface of a paper roll formed of rolled paper as a print medium and a drawer portion for delivering the paper roll to the printing section side. In this printer, moreover, a guide member is located in a paper course formed between the receiving portion and the drawer portion such that the guide member restricts the paper course between the receiving portion and the drawer portion to the receiving portion side.

One end of the guide member may be fixed to a fixing member on the printing section side, and a free end or the other end thereof may be configured to act on the paper sheet.

The paper course from the receiving portion to the drawer portion may be bent by the guide member so that it is divided into a paper course from the receiving portion to the guide member and a paper course from the guide member to the drawer portion, the two paper courses forming an angle within a range of 90° to 160°.

A separator configured to act on the paper sheet immediately before passing through the drawer portion and to engage a turn-up formed at a terminal end of the paper sheet when the paper sheet is wound on a roll core may be provided between the guide member and the drawer portion.

According to the present invention, the paper roll is prevented from lifting upward in the paper roll holder when the paper roll is paid out by a feed-in roller in the printing section, so that wrong operation of a sensor for detecting a shortage of the residual quantity of the paper roll can be avoided, and the generation of noise by the lift of the paper roll can be eliminated.

BEST MODE FOR CARRYING OUT THE INVENTION

Figure 1:
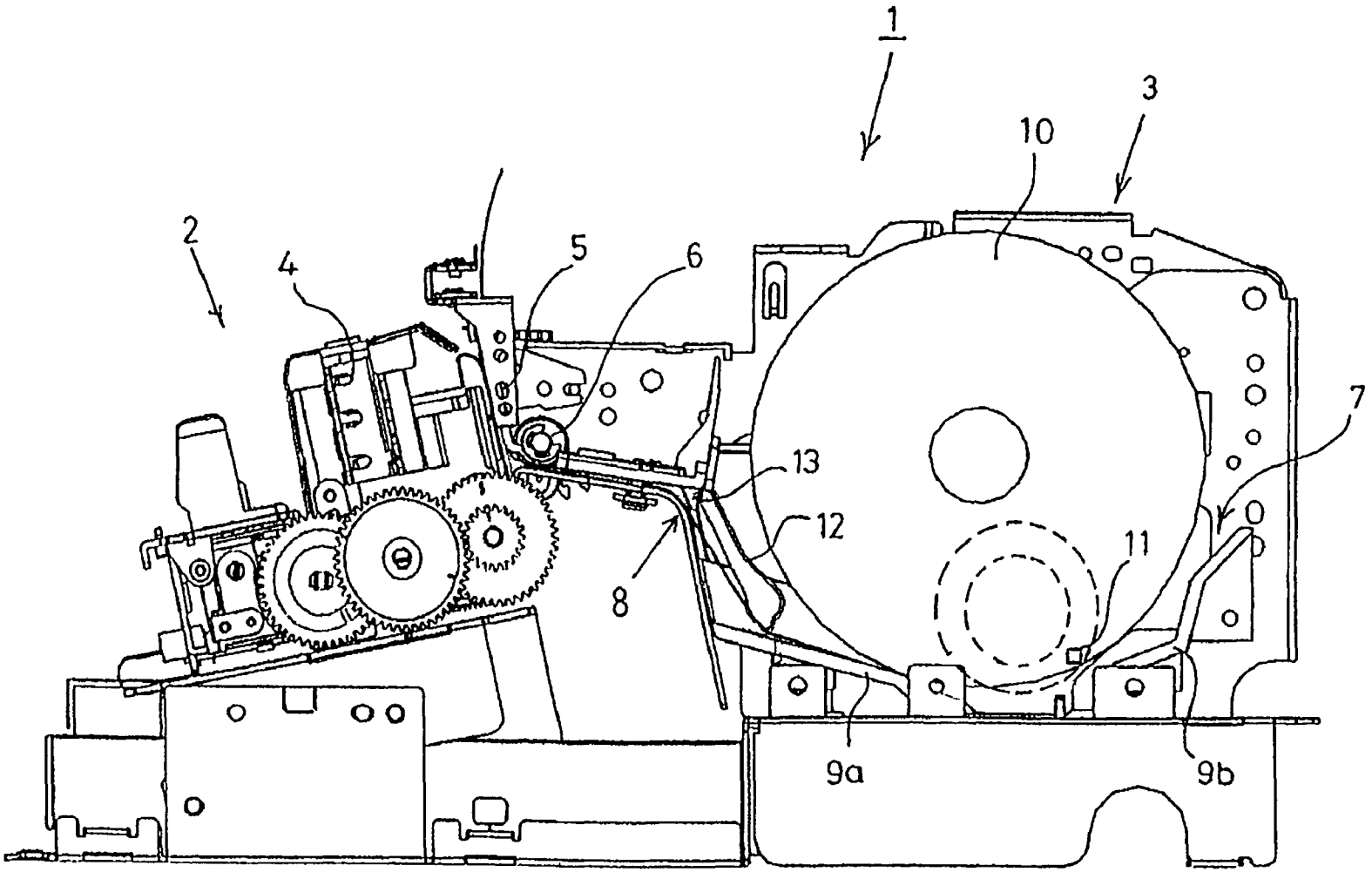
FIG. 1 is a side view showing an example of a horizontal printer in which a paper roll holder is located beside a printing section.

FIG. 1 shows a horizontal printer 1 in which a paper roll holder 3 is located beside a printing section 2. The printing section 2 is of a publicly known structure and comprises a print head 4, a platen 5, and a pair of feed-in rollers 6. As the feed-in rollers 6 rotate, a paper sheet is drawn out of the paper roll holder 3 and fed in between the print head 4 and the platen 5.

The paper roll holder 3, which substantially has the shape of a container, is made of a synthetic resin and comprises a receiving portion 7 and a drawer portion 8. The receiving portion 7 is composed of a pair of bottom plates 9*a* and 9*b*, front and rear, which decline toward its center to support a paper roll from below and prevent the paper roll from rolling back and forth.

The drawer portion 8 is formed in a region opposite the printing section 2 of the paper roll holder 3. The paper sheet is passed through the drawer portion 8 to the outside of the paper roll holder 3 and fed in between the print head 4 and the platen 5. Since the print head 4 and the platen 5 are normally situated in a position higher than the receiving portion 7 (bottom plates 9*a* and 9*b*) of the paper roll holder 3, as shown in FIG. 1, the drawer portion 8 of the paper roll holder 3 is also normally provided in a position higher than the receiving portion 7.

In FIG. 1, solid lines represent an unused form of a paper roll 10 placed on the bottom plates 9*a* and 9*b* of the receiving portion 7, and broken lines represent a low-residue form. A near-end sensor 11 serves to detect that the residual quantity of the paper roll 10 in the paper roll holder 3 is reduced below a predetermined value. The near-end sensor 11 is formed of a reflector-type photosensor, which detects whether or not the residual quantity of the paper roll 10 is smaller than the predetermined value by determining whether or not a light receiving section (not shown) is reached by light that is emitted from a light emitting section (not shown) and reflected by the side end face of the paper roll 10 on the receiving portion 7. If the residual quantity of the paper roll 10 is reduced so that the diameter of the roll is smaller than a given value, the light emitted from the light emitting section of the near-end sensor 11 passes without hitting the side end face of the paper roll 10.

In the printer 1 shown in FIG. 1, the paper sheet paid out from the paper roll 10 is led out of the paper roll holder 3 through the drawer portion 8 after it is temporarily bent substantially in the shape of a V by a guide member 12.

Figure 2:
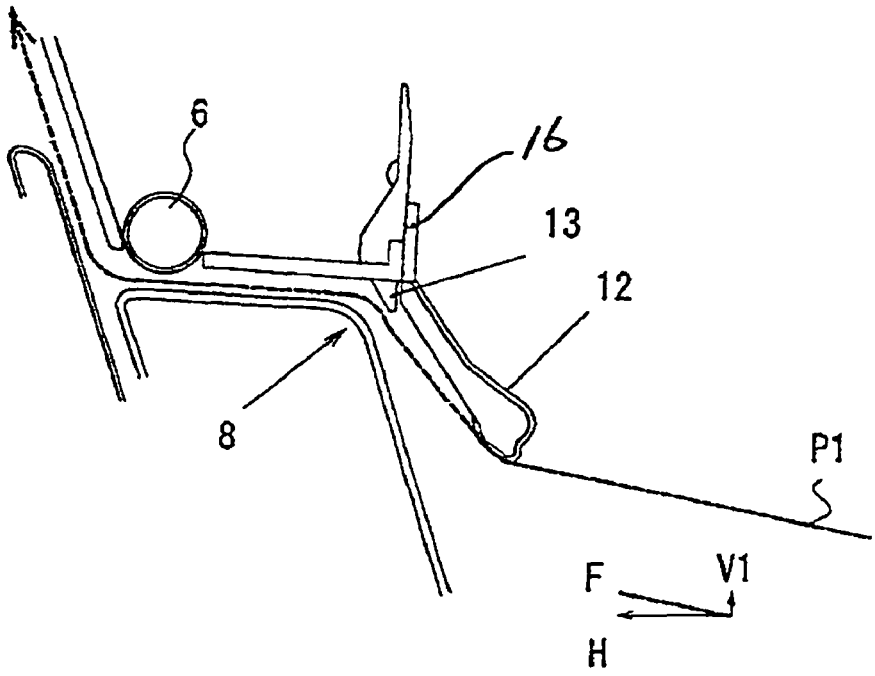
FIG. 2 is a view illustrating how a paper sheet paid out from a paper roll in the printer of FIG. 1 is inclined to be substantially horizontal by being guided by a guide member.

As shown in FIG. 2, the proximal end of the guide member 12 is fixed to a fixing member 16 of the printing section 2 that faces the paper roll holder 3. On the other hand, a free end or the distal end of the guide member 12 extends toward the inner part of the paper roll holder 3 and acts on a paper sheet P1 that, although paid out from the paper roll 10, is not passed through the drawer portion 8 yet. Thereupon, the paper sheet P1 is pushed downward and bent substantially in the shape of a V. In the present embodiment, a paper course that extends from the receiving portion 7 to the drawer portion 8 is bent by the guide member 12 and divided into a paper course from the receiving portion 7 to the guide member 12 and a paper course from the guide member 12 to the drawer portion 8. An angle formed between these two paper courses is within a range from 90° to 160° (preferably at about 140°). In consequence, the paper sheet is at a substantially horizontal angle when it is paid out from the paper roll 10 and moves.

Figure 3:
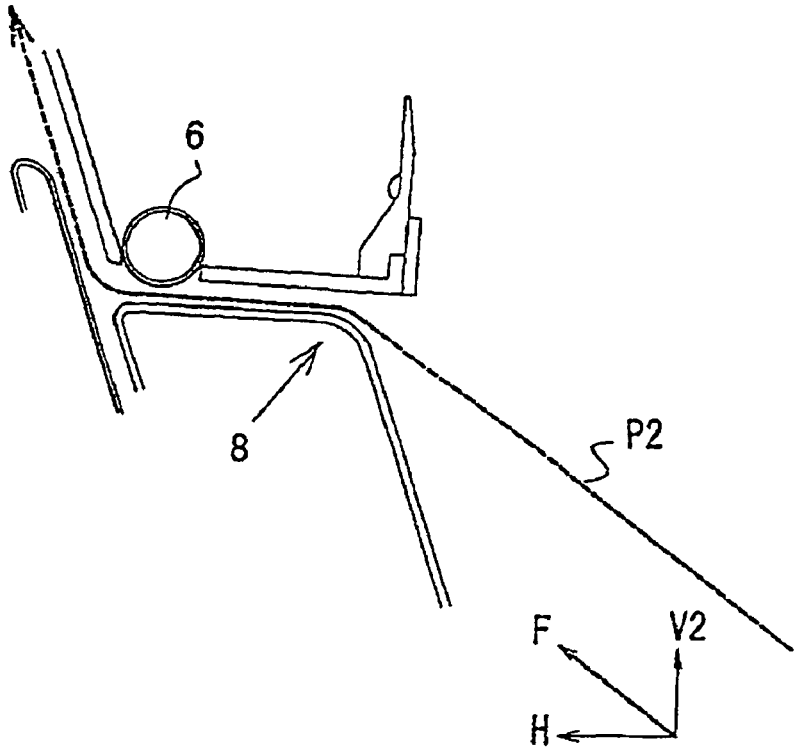
FIG. 3 is a view illustrating how the paper sheet paid out from the paper roll is inclined if the printing section is not provided with the guide member shown in FIG. 2.

FIG. 3 is a view illustrating how a paper sheet P2 moves on one straight line from a position in which it is paid out from the paper roll to the drawer portion 8 in the case where the printing section 2 is not provided with the guide member 12. Comparison between FIGS. 3 and 2 indicates that the angle (FIG. 2) of the paper sheet P1 that is guided by the guide member 12 is nearer to the horizontal angle than the angle of the paper sheet P2 (FIG. 2) that is not guided by the guide member.

Although the guide member 12 is provided on the fixing member 16 on the side of the printing section 2 in this example, guide member 12 may alternatively be fixed to a fixing member on the side of the paper roll holder 3. It is necessary that the proximal end of the guide member 12 be fixed to the fixing member of the printer and the distal end thereof act on the paper sheet P1 that is not passed through the drawer portion 8 yet, thereby bending the paper sheet P1.

The function of the guide member 12 will now be described with reference to FIGS. 2 and 3.

A force that causes the paper roll 10 to lift off the receiving portion 7 as the paper sheet is paid out from the paper roll 10 is settled depending on a vertical component of the force that is generated when the paper sheet is paid out from the paper roll 10. Thereupon, if the paper sheet P1 paid out from the paper roll 10 is inclined to be substantially horizontal by being guided by the guide member 12, a vertical component V1 of a force F that is generated when the paper sheet is paid out from the paper roll 10 is smaller than a vertical component V2 of the force F that is generated when the paper sheet is paid out from the paper roll 10 without the use of the guide member 12 (FIG. 3).

Thus, it can be seen that even though the paper sheet is paid out from the paper roll 10 with the same force F, a force that causes the paper roll 10 to spring up from the receiving portion 7 can be made smaller than without the use of the guide member 12 if the inclination of the paper sheet is approximated to the horizontal angle by means of the guide member 12.

As described above, the paper roll 10 can be prevented from lifting off the receiving portion 7 by approximating the inclination of the paper sheet paid out from the paper roll 10 to the horizontal angle to reduce the vertical component V1 of the force F that is generated when the paper sheet is paid out from the paper roll 10. Actually, however, the paper roll 10 is placed on the receiving portions 9*a* and 9*b* that are inclined in the manner shown in FIG. 1, so that it is difficult to incline by the guide member 12 the paper sheet P1 from the paper roll 10 to a degree greater than the inclination of the receiving portion 9*a* that is nearer to the drawer portion 8. In practice, therefore, the guide member 12 is set so that the paper sheet P1 can be paid out substantially parallel to the receiving portion 9*a* from the paper roll 10.

According to this embodiment, as described above, the paper roll 10 is prevented from being lifted off the receiving portion 7 by the force that is generated when the paper sheet is paid out from the paper roll 10, so that the paper sheet paid out from the paper roll 10 can be steadily fed to the side of the printing section 2, and the residual quantity can be accurately detected by the near-end sensor 11.

Moreover, the printing section 2 of the printer 1 of FIG. 1 is further provided with a separator 13 in the vicinity of the drawer portion 8 of the paper roll holder 3. As shown in the enlarged views of FIGS. 6 and 7, this separator 13 is composed of a lug 13*a* that projects toward a surface of the paper sheet P and a slit 13*b* that is provided adjacent to the downstream side (side of the receiving portion 7) of the lug 13*a*. The following is a description of the function of the separator 13.

Figure 4:
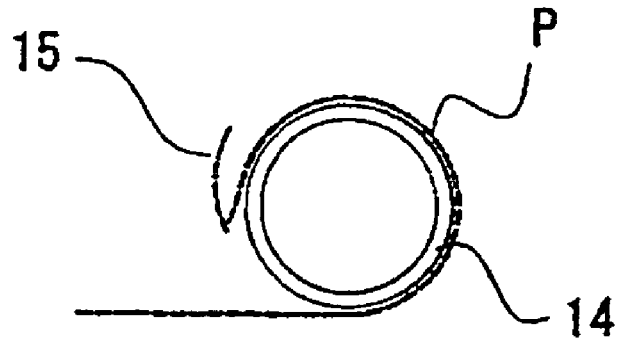
FIG. 4A is a view showing a state in which an approximately one turn of the paper sheet remains on a roll core.
FIG. 4B is a view showing how the paper sheet disengaged from the roll core is fed in the paper roll holder toward the printing section in a manner such that it maintains a curl formed when it is wound on the roll core and that a turn-up is oriented in the direction of delivery of the paper sheet.
Figure 4:
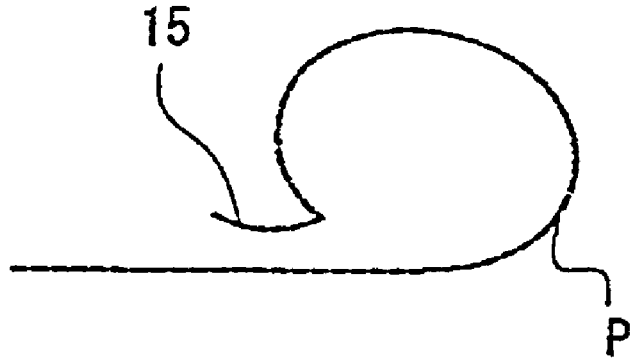
Figure 6:
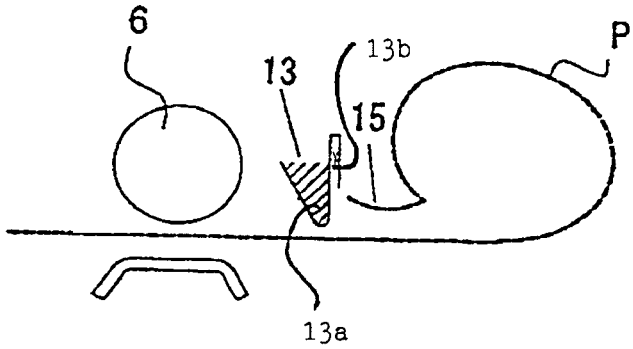
FIG. 6 is a view illustrating a state immediately before the paper sheet shown in FIG. 4B is further fed so that its turn-up engages the lug of the separator.

If the paper roll 10 is formed by winding an elongate paper sheet around a roll core 14, a winding-side end portion (turn-up 15) of the paper sheet P is turned back outward, as shown in FIG. 4A. In this case, the paper sheet should not be bonded to the roll core with an adhesive. If the feed-in rollers 6 are driven to pay out the paper sheet entirely from the paper roll 10 thus formed by winding, the paper sheet P is disengaged from the roll core 14 and moves in the paper roll holder 3 toward the drawer portion 8 of the paper roll holder 3 in a manner such that it maintains a curl formed when it is wound on the roll core 14 and that the turn-up 15 is oriented in the direction of delivery of the paper sheet P, as shown in FIGS. 4B and 6.

Figure 5:
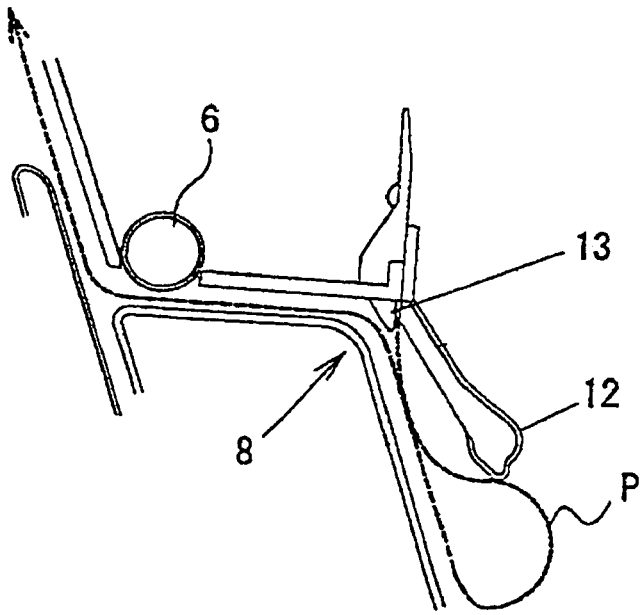
FIG. 5 is a view illustrating the way the leading end of the turn-up at a terminal end of the paper sheet abuts against a lug of a separator and gets into a slit in the printer of FIG. 1.
Figure 7:
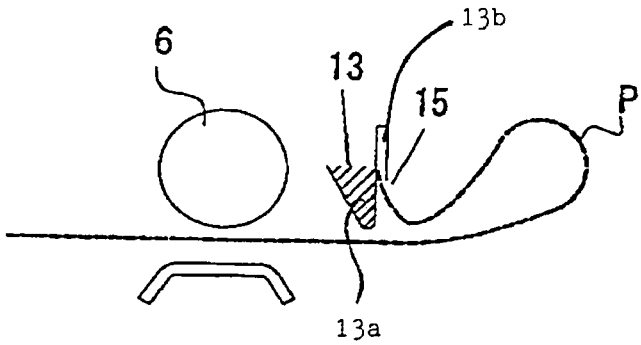
FIG. 7 is a view illustrating a state in which the paper sheet shown in FIG. 6 is further fed so that its turn-up is in the slit behind the lug of the separator.

If the paper sheet P shown in FIG. 4B is drawn out to the drawer portion 8, the leading end of the turn-up 15 abuts against the lug 13*a* of the separator 13 and gets into the slit 13*b*, as shown in FIG. 5 (and FIG. 7).

Figure 8:
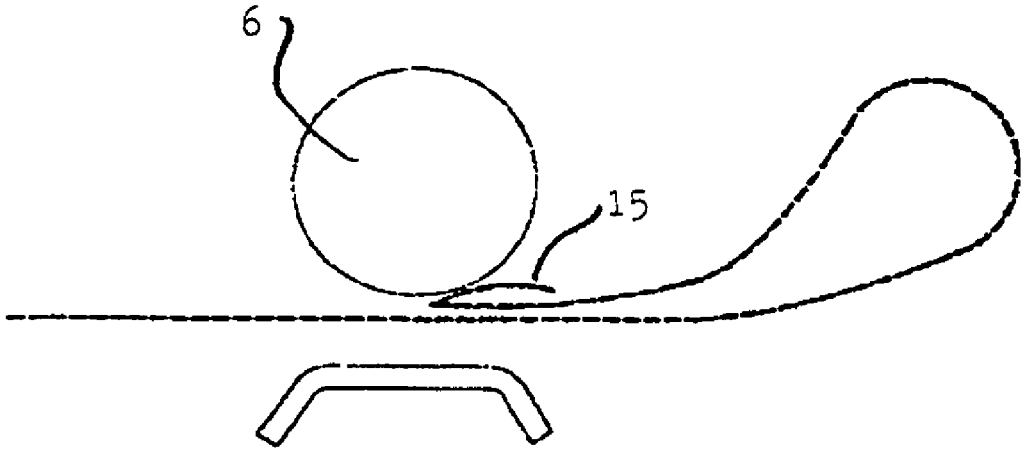
FIG. 8 is a view illustrating how the turn-up is inevitably lapped on the paper sheet by feed-in rollers in the case where the printer of FIG. 6 is not provided with the separator.

If the feed-in rollers 6 are rotated, moreover, the paper sheet P touches the distal end of the lug 13*a* as it is drawn in with its turn-up 15 kept in the slit 13*b* of the separator 13. In consequence, the curl of the paper sheet P is reformed by the lug 13*a*. When the turn-up 15 finally gets out of the slit 13*b* and reaches the feed-in rollers 6, the fold of the turn-up 15 is eliminated. Thus, the turn-up 15 can be prevented from lapping on the paper sheet in the manner shown in FIG. 8 as the paper sheet passes under the feed-in rollers 6. In consequence, paper jamming under the feed-in rollers 6 by the turn-up 15 can be avoided.

Figure 9:
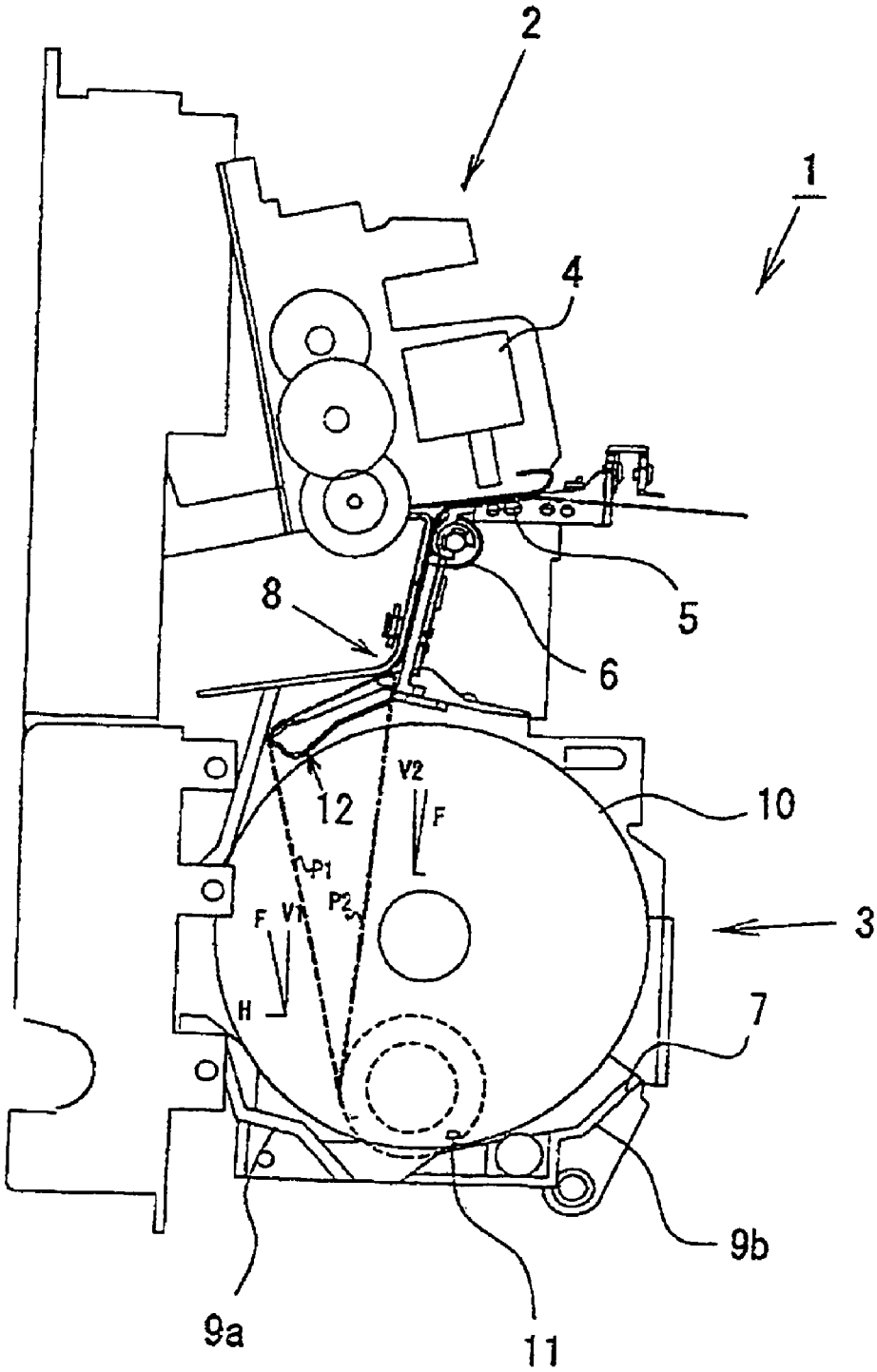
FIG. 9 is a side view showing an example of a vertical printer in which a paper roll holder is located under a printing section.

FIG. 9 shows an example of a vertical printer 1 in which a paper roll holder 3 is located under a printing section 2. Since the respective configurations of the printing section 2 and the paper roll holder 3 that constitute the printer 1 of FIG. 9 are substantially the same as the respective configurations of the printing section 2 and the paper roll holder 3 that constitute the printer 1 of FIG. 1, a specific description of those configurations is omitted.

The proximal end of a guide member 12 is fixed to a fixing member of the printing section 2 that faces the paper roll holder 3. A free end or the distal end of the guide member 12 extends toward the inner part of the paper roll holder 3 and laterally acts on the paper sheet P1 (FIG. 2) that, although paid out from a paper roll 10, is not passed through a drawer portion 8 yet.

FIG. 9 indicates that the paper sheet P1 that is paid out from the paper roll 10 (represented by dotted lines) with a reduced residual quantity is passed through the drawer portion 8 after being bent substantially in the shape of a V by the distal end of the guide member 12 and fed in between a print head 4 and a platen 5. In this drawing, moreover, an imaginary line for illustration indicates a state in which the paper sheet P2 paid out from the paper roll 10 passes through the drawer portion 8 when the guide member 12 is not provided.

In the present embodiment, a paper course that extends from a receiving portion 7 to the drawer portion 8 is bent by the guide member 12 and divided into a paper course from the receiving portion 7 to the guide member 12 and a paper course from the guide member 12 to the drawer portion 8. An angle formed between these two paper courses is within a range from 90° to 160° (preferably at about 110°).

As seen from FIG. 9 in which the paper sheet P1 represented by a dotted line is compared with the paper sheet P2 represented by an imaginary line, the inclination of the paper sheet is gentle if the paper sheet is guided by the guide member 12. Therefore, a vertical component V1 of a force F that is generated when the paper sheet is paid out from the paper roll 10 is smaller than a vertical component V2 of the force F that is generated when the paper sheet is paid out from the paper roll 10 without the use of the guide member 12. Thus, the lightened paper roll 10 with a reduced residual quantity can be prevented from being lifted off the receiving portion 7 by the delivery of the paper sheet.

In the printer 1 of FIG. 9, however, the use of the guide member 12 may possibly increase the vertical component V1 of the force F attributable to the delivery of the paper sheet from the paper roll 10 if the residual quantity of the paper roll 10 is large. Owing to its own weight, however, the paper roll with the large residual quantity cannot easily lift off, so that there is no special problem about fixed-rate feed.

According to this embodiment, as described above, the paper roll 10 is prevented from being lifted off the receiving portion 7 by the force that is generated when the paper sheet is paid out from the paper roll 10, so that the paper sheet paid out from the paper roll 10 can be steadily fed to the side of the printing section 2, and the residual quantity can be accurately detected by the near-end sensor 11.

Like that of the printer 1 of FIG. 1, moreover, the printing section 2 of the printer 1 of FIG. 9 is also provided with a separator 13 in the vicinity of the drawer portion 8 of the paper roll holder 3, so that paper jamming under feed-in rollers 6 by a turn-up that is formed when the paper sheet is wound on a roll core can be avoided.

The invention claimed is:

1. A printer comprising a printing section and a paper roll holder, wherein the paper roll holder has a receiving portion which supports an outer peripheral surface of a paper roll formed of rolled paper as a print medium and a drawer portion for delivering the paper roll to the printing section side, a guide member is located in a paper course formed between the receiving portion and the drawer portion such that the guide member restricts the paper course between the receiving portion and the drawer portion to the receiving portion side, one end of the guide member is fixed to a fixing member on the printing section side, and a free other end thereof acts on the paper sheet at the portion where it has not passed through said drawer portion yet, wherein said receiving portion is arranged at the bottom of the paper roll holder to support the paper roll in a direction of gravitational force, and said free end of the guide member, acting on the paper sheet at the portion where it has not passed through said drawer portion yet, causes the paper sheet to bend towards the receiving portion side, thereby bringing the inclination of the paper sheet that is paid out from the paper roll to be close to a horizontal direction, with the result that the vertical component of the force that is generated when the paper sheet is paid out from the paper roll is reduced so that the paper sheet is prevented from lifting off the receiving portion, and a separator configured to act on the paper sheet immediately before passing through the drawer portion and to engage a turn-up formed at a terminal end of the paper sheet when the paper sheet is wound on a roll core is provided between the guide member and the drawer portion.

2. The printer according to claim 1, wherein the paper course from the receiving portion to the drawer portion is bent by the guide member and is divided into a paper course from the receiving portion to the guide member and a paper course from the guide member to the drawer portion, the two paper courses forming an angle within a range of 90° to 160°.

3. The printer according to claim 1, wherein the separator is formed of a lug projecting toward a surface of the paper sheet and a slit provided adjacent to the receiving portion side of the lug, the turn-up formed at the terminal end of the paper sheet when the paper sheet is wound on the roll core abuts against the lug and partially gets into the slit when fed by rotation of a feed-in roller, and the paper sheet touches a distal end of the lug as the paper sheet is drawn in with a part of the lug kept in the slit so that a curl of the paper sheet is reformed by the lug.

* * * * *